US005457970A

United States Patent [19]

Gutkin

[11] Patent Number: 5,457,970

[45] Date of Patent: Oct. 17, 1995

[54] METHOD FLUID TREATMENT OF CLOTHES IN WASHING MACHINE "OR" THE WASHING MACHINE OF HIGH EFFICIENCY

[76] Inventor: Timothy Gutkin, 1420 Ocean Park Way Apt. 6E, Brooklyn, N.Y. 11230

[21] Appl. No.: 188,881

[22] Filed: Jan. 31, 1994

[51] Int. Cl.[6] ..... D06F 21/08; D06F 37/12

[52] U.S. Cl. ..... 68/23.5; 68/148; 68/171

[58] Field of Search ..... 68/23.2, 23.5, 68/148, 152, 154, 171, 174; 8/158, 159

[56] References Cited

U.S. PATENT DOCUMENTS

| | | | |
|---|---|---|---|
| 776,295 | 11/1904 | Cohen | 68/148 |
| 1,234,498 | 7/1917 | Seymour | 68/148 X |
| 1,682,473 | 8/1928 | Bercaw | 68/152 X |
| 2,584,833 | 2/1952 | Beucler | 68/148 X |
| 3,987,508 | 10/1976 | Platt | 8/159 |
| 4,356,711 | 11/1982 | Okazaki | 68/148 X |

FOREIGN PATENT DOCUMENTS

| | | | |
|---|---|---|---|
| 423549 | 2/1912 | France | 68/152 |
| 1041214 | 5/1953 | France | 68/148 |
| 209396 | 11/1984 | Japan | 68/148 |

*Primary Examiner*—Philip R. Coe
*Attorney, Agent, or Firm*—Ilya Zborovsky

[57] ABSTRACT

The washing machine of high efficiency in which the washing solution is placed inside immovable tank, while washing of clothes is done in rotating preforating drain washing process take place as result under the action of centrifugal force washing solution with great speed pass through pores of clothes. In washing machine significantly simplifies electrical scheme and guarantees a decrease of wearing out of parts of equipment and seriously increases resources. Technology of making it is much easier, what leads to decrease of consumption of materials and cost of the machine when it is produced.

8 Claims, 3 Drawing Sheets

FIG 2
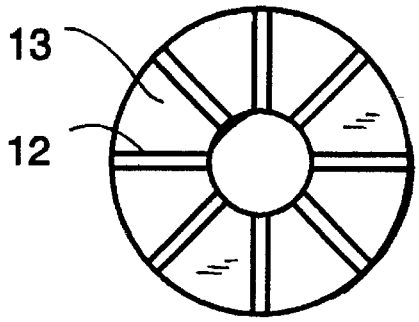
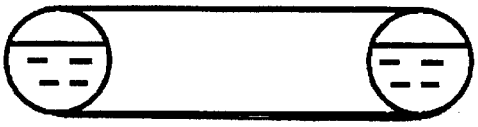
FIG 4
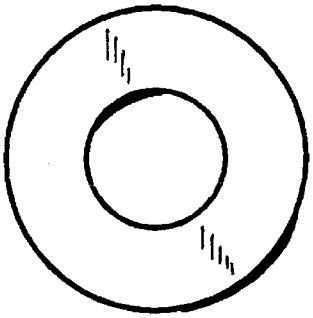
FIG 5

METHOD FLUID TREATMENT OF CLOTHES IN WASHING MACHINE "OR" THE WASHING MACHINE OF HIGH EFFICIENCY

BACKGROUND OF THE INVENTION

The present invention relates to a washing machine of a drum type for washing synthetic, cotton, wool, linen and other fabrics with pressing of the fabrics.

In a known washing machine the fabric is introduced into a washing tank, then a detergent is poured into the tank and an activator is rotated by an electric motor. A washing solution is driven by the activator in rotating motion so as to moved relative to the fabric. However, in a known washing machine the fabric is also moved by the washing solution, and therefore the speed of movement of the fabric relative to the washing solution rapidly decreases and therefore intensity of washing is reduced. In order to improve the quality of washing the time of washing has to be increased. Also, before the washing itself, the fabric must be soaked in the solution. In order to be pressed, the clothes have to be centrifuged by the electric motor. This method has a low efficiency of washing especially for very dirty fabrics which need a lengthy washing process. It is also necessary to use two different volumes, one for washing and another for pressing, and two electric motors or one electric motor with two windings which can be switched over. The electricity consumption is substantial. The fabric is subjected to wear during washing.

In order to avoid rotation of the fabric by the washing fluid and to increase the efficiency of washing, a system with a reverse movement of the drum is utilized. In accordance with this system the fluid treatment of the fabric in the washing machine includes placing the fabric into the drum, filling the drum with a washing fluid, and performing the subsequent cycle of treatment of fabric with a reverse of the drum. This method however increases wear of the elements due to the reverse of the drive. In this construction also tangential forces in the rotating elements are generated, the active current of the electric motor is increased, and there are peaks of current which lead to additional loss of energy and overheating. Also, an electric motor of high power is to be used. In addition, the reverse movement of the drum requires considerably complicated mechanical construction which complicates the manufacture and increases the price of the washing machine. Also, such washing machine has a high consumption of energy and needs a long time for reversing of the whole mass of washing fluid. When the fluid starts moving, the fabric also starts to move in the same direction. Therefore, the reverse method is not very efficient and does not substantially improve the washing process.

SUMMARY OF THE INVENTION

Accordingly, it is an object of the present invention to provide a washing machine which avoids the disadvantages of the prior art.

More particularly, it is an object of the present invention to provide a washing machine in which the washing process is intensified and accelerated, dirty fabrics can be reliably washed, wearing out of fabrics during the washing is prevented, elements of the machine have longer service life, and electric power consumption and detergent consumption are reduced.

In keeping with these objects and with others which will become apparent hereinafter, one feature of the present invention resides, briefly stated, in a washing machine in which fabric is placed in a drum between acceleration elements formed for example as a net and a cylindrical surface of the perforating drum, the washing solution is placed inside an immovable tank, and washing is performed in the rotating perforating drum. When the perforating drum is rotated, washing solution is supplied to an immovable perforated pipe located along a rotary axis of the drum, and exits the pipe to be directed to elements which rotate the washing solution to be applied on an inner layer of the fabric. Under the action of centrifugal force acting on the washing solution, the latter penetrates perpendicularly through the layer of the rotating fabric with a high speed so that the action of the washing solution on the fabric is considerably increased. The supply of the washing solution into the perforated pipe and its discharge through the perforated surface of the drum is determined by the number and cross-section of the openings for preventing filling of the drum with the washing solution. Also, the quantity of the supplied solution into the perforated pipe can be regulated by a degree of opening of a throughgoing faucet.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a top view of accelerating element of the inventive washing machine;

FIG. 4 is a front view of a self-balanced construction of the washing machine; and FIG. 5 is a top view of the self-balanced construction of the washing machine.

DESCRIPTION OF THE PREFERRED EMBODIMENTS

Figure 1:
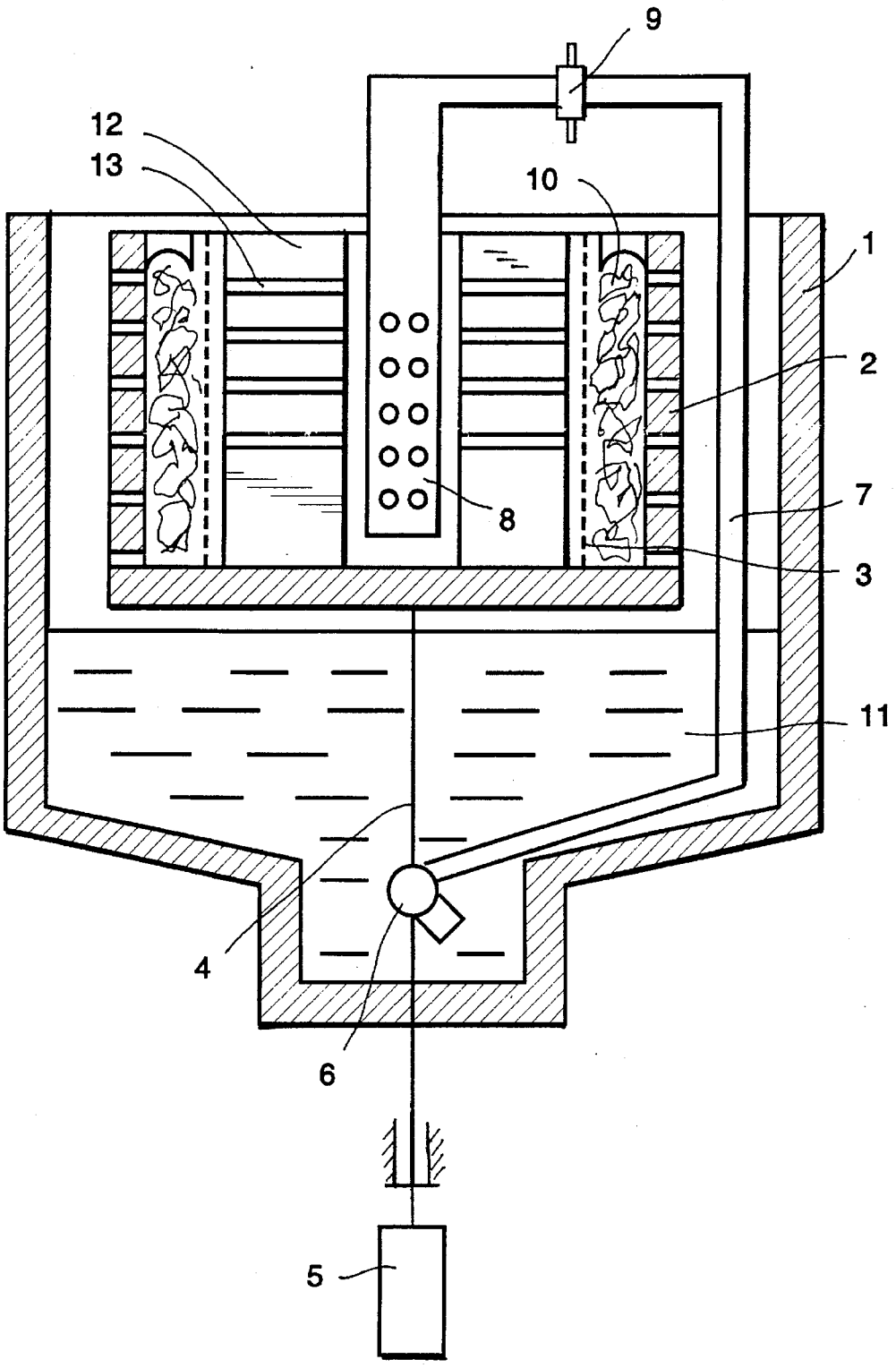
FIG. 1 is a front view of a washing machine in accordance with the present invention.

A washing machine in accordance with the present invention has an immovable tank which is identified with reference numeral 1. A perforated drum 2 is located in the tank and has a cylindrical surface. Accelerating elements 3 formed for example as nets (sieves) are connected with the drum and rotated together with it. A shaft 4 connects the drum 2 with the accelerating elements 3 to an electric motor 5. A pump 6 rotated by the shaft 4 is connected by a pipeline 7 to a perforated pipe 8. A switching valve 9 is provided for regulating a quantity of washing solution supplied to the perforated pipe, or switching the stream of washing solution to the tank 1 for the fabric to be pressed by centrifugal forces, for removing the washing solution 11 from the tank 1 after the washing process. A not shown seal is used for preventing leakage of the washing solution 11 in the location where the shaft 4 passes through the tank.

The washing machine operates in the following manner.

The washing solution 11 is introduced into the immovable tank 1. A fabric 10 is placed between the cylindrical surface of the drum 2 and the accelerating elements 3. The switching valve 9 is turned to a position in which the washing solution is supplied into the perforated pipe 8 through the pipeline 7. The electric motor 5 and the pump are turned on at the same time. The washing process is therefore carried out. The fabric 10 and the drum 2 are rotated together. The washing solution from the immovable tank 1 is supplied through the switching valve 9, the pipeline 7 and the perforated pipe 8 to the accelerating elements 3. The washing solution is rotated by the accelerating elements with high angular velocity. As a result of the centrifugal force acting on the washing solution, the washing solution is applied on and penetrates through an inner layer of the fabric. Then the washing solution is again supplied through a bottom opening in the perforated drum 2 into the tank 1, and the washing process continuous.

Figure 3:
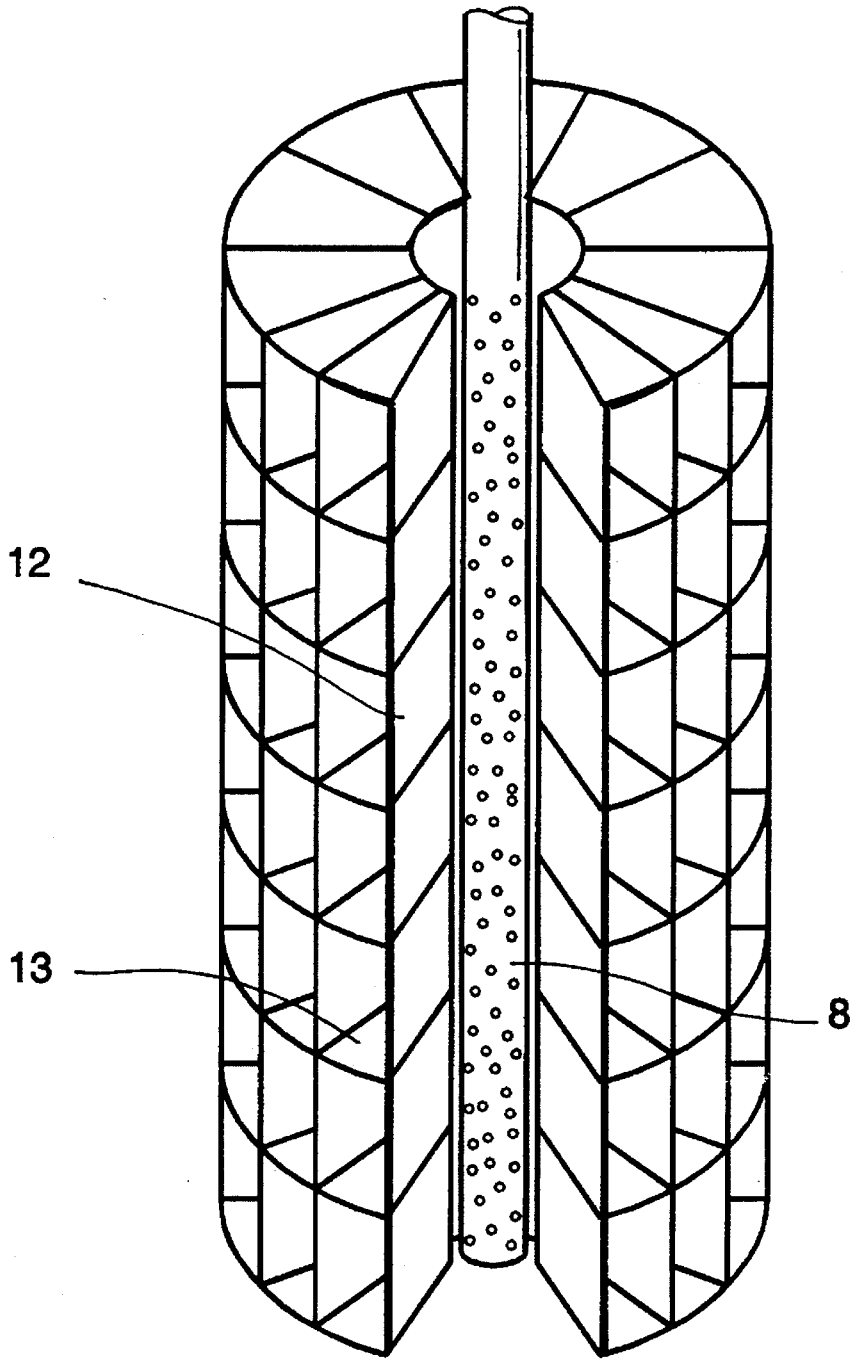
FIG. 3 is a side view of a perforated pipe and the accelerating elements formed as a net of the inventive washing machine.

In accordance with an important feature of the present invention, flat horizontal elements are utilized for preventing flowing out the washing solution so that the whole mass of the washing solution supplied from the pipe 8 is involved in the rotary movement. As a result, the speed of passage of the washing solution through pores of the fabric is increased under the action of a centrifugal force acting on the rotating solution. FIG. 2 shows flat vertical elements identified with reference numeral 12 and the horizontal vertical elements shown in section and identified with reference numeral 13. The net 3 is composed of the flat vertical elements 12 and the ring-shaped horizontal elements 13 connected with one another as shown in FIG. 3. The net is attached to the bottom of the drum, for which purpose it is provided with a not shown flange which has openings for a screw connection to the drum bottom.

For pressing the fabric, the supply of the washing solution into the pipe 8 is interrupted, when the drum is still rotated, by the switching valve 9 until the fabric looses its moisture substantially. After the end of the washing, a not shown faucet which connects the exterior part of the pipeline 7 with a drainage is opened. The washing solution is drained, the empty tank 1 is filled with water. The process of rinsing the fabric is performed analogously to the washing process. Then the water is drained, but the drum 2 continues its rotation for pressing of the fabric. After this the motor 5 of the drum 2 is turned off, and the drainage of the solution and water can be performed through the bottom of the tank 1 by a special faucet. The tank 1, the electric motor 5, the pump 6 are mounted on a structure which can be arranged on the floor.

When the machine is designed in accordance with the present invention there is no movement of the fabric by the washing solution during the washing process, with no reverse so that an electrical circuit is simplified and wear is reduced. Efficient passage of washing solution through the fabric increases the quality of washing. Due to intensification of the washing process a washing time is reduced and therefore electrical energy is saved. The fabric is not moved by the washing solution so that there wear of the fabric during the washing process. Washing of fabrics with different structures, colors and dirtiness can be performed. Detergent consumption is decreased in half when compared with known washing machines. It is not necessary to first moisturize the fabric before the washing process. The washing machine has a simpler construction and is less expensive to manufacture.

I claim:

1. A washing machine, comprising an immovable tank; a perforated drum rotating inside said tank; and a plurality of accelerating elements located inside said perforated drum so that a fabric to be washed is placed between said accelerating elements and an inner cylindrical surface of said perforated drum, said elements including planar vertical elements located along a plurality of radii, and planar horizontal circular elements connected with said planar vertical elements.

2. A washing machine as defined in claim 1; and further comprising means for supplying a washing solution into an interior of said immovable tank, while the fabric is located inside said rotating perforated drum.

3. A washing machine as defined in claim 1; and further comprising an immovable perforated pipe arranged so that when said perforated drum is rotated, a washing solution is supplied from said perforated pipe.

4. A washing machine as defined in claim 1, wherein said perforating pipe and said elements are arranged so that the washing solution is first rotated and then applied to an inner layer of the fabric located between said accelerating elements and said inner surface of said perforated drum.

5. A washing machine as defined in claim 1, wherein said elements are formed so that the washing solution is forced under the action of a centrifugal force to pass through pores of the fabric.

6. A washing machine as defined in claim 1, wherein said planar horizontal circular elements are formed as nets.

7. A washing machine as defined in claim 1; and further comprising a switching valve which is formed so as to regulate a supply of the washing solution to said drum.

8. A washing machine, comprising an immovable tank; a perforated drum rotating inside said tank; a plurality of accelerating elements located inside said perforated drum so that a fabric to be washed is placed between said accelerating elements and an inner cylindrical surface of said perforated drum; and an immovable perforated pipe arranged so that when said perforated drum is rotated, a washing solution is supplied from said perforated pipe, said elements including planar vertical elements located along a plurality of radii, and planar horizontal circular elements connected with said planar vertical elements.

* * * * *